US010604220B2

(12) United States Patent
Sakaue et al.

(10) Patent No.: US 10,604,220 B2
(45) Date of Patent: Mar. 31, 2020

(54) AUTONOMOUS UNDERWATER VEHICLE

(71) Applicant: KAWASAKI JUKOGYO KABUSHIKI KAISHA, Kobe-shi, Hyogo (JP)

(72) Inventors: Hiroshi Sakaue, Kobe (JP); Minehiko Mukaida, Kobe (JP); Noriyuki Okaya, Kobe (JP); Takashi Okada, Kobe (JP); Fumitaka Tachinami, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 16/065,170

(22) PCT Filed: Oct. 11, 2016

(86) PCT No.: PCT/JP2016/004537
§ 371 (c)(1),
(2) Date: Jun. 22, 2018

(87) PCT Pub. No.: WO2017/110026
PCT Pub. Date: Jun. 29, 2017

(65) Prior Publication Data

US 2019/0002070 A1 Jan. 3, 2019

(30) Foreign Application Priority Data

Dec. 22, 2015 (JP) ..... 2015-249967

(51) Int. Cl.

| | |
|---|---|
| ***B63G 8/40*** | (2006.01) |
| ***B63G 8/00*** | (2006.01) |
| ***B63C 11/48*** | (2006.01) |
| ***B63B 22/06*** | (2006.01) |

(Continued)

(52) U.S. Cl.
CPC ..... *B63G 8/001* (2013.01); *B63B 22/06* (2013.01); *B63B 22/18* (2013.01); *B63C 11/48* (2013.01); *B63B 2027/165* (2013.01); *B63G 2008/004* (2013.01)

(58) Field of Classification Search
CPC . B63G 8/00; B63G 8/001; B63G 8/28; B63G 8/40; B63G 8/41; B63G 8/42; B63G 2008/00; B63G 2008/001; B63G 2008/002; B63G 2008/004; B63G 2008/40; B63G 2008/42; B63B 22/18
USPC ..... 114/312, 313, 321, 322, 326, 328, 329, 114/327
See application file for complete search history.

(56) References Cited

U.S. PATENT DOCUMENTS 3,581,693 A * 6/1971 Basset ..... B63C 7/26 114/328
3,933,109 A * 1/1976 Boisrayon ..... B63C 7/26 114/328

(Continued)

FOREIGN PATENT DOCUMENTS

JP 2012-229005 A 11/2012

*Primary Examiner* — Daniel V Venne
(74) *Attorney, Agent, or Firm* — Oliff PLC

(57) ABSTRACT

An autonomous underwater vehicle including an underwater vehicle main body incorporating a power source, a buoy connected to the underwater vehicle main body through a rope, and an ejector configured to, with the underwater vehicle main body floating on a sea surface, eject the buoy from the underwater vehicle main body by compressed gas in an obliquely upward direction.

6 Claims, 2 Drawing Sheets

(51) Int. Cl.
*B63B 22/18* (2006.01)
*B63B 27/16* (2006.01)

(56) References Cited

U.S. PATENT DOCUMENTS

| | | | | | |
|---|---|---|---|---|---|
| 3,961,589 | A * | 6/1976 | Lombardi | B63G 8/42 | 114/328 |
| 5,379,034 | A * | 1/1995 | O'Connell | F42B 12/365 | 114/328 |
| 6,058,874 | A * | 5/2000 | Glenning | B63G 8/38 | 114/244 |
| 6,390,012 | B1 * | 5/2002 | Watt | B63B 27/36 | 114/322 |
| 6,600,695 | B1 * | 7/2003 | Nugent | B63G 8/42 | 114/312 |
| 8,340,844 | B2 * | 12/2012 | Scoca | G01C 21/00 | 114/328 |
| 2012/0118217 | A1 * | 5/2012 | Bertelsen | B63B 27/36 | 114/326 |
| 2018/0001981 | A1 * | 1/2018 | Boss | B63G 8/16 | |
| 2018/0327057 | A1 * | 11/2018 | Pastor | B63B 27/36 | |

* cited by examiner

AUTONOMOUS UNDERWATER VEHICLE

TECHNICAL FIELD

The present invention relates to an autonomous underwater vehicle.

BACKGROUND ART

Conventionally known is an autonomous underwater vehicle (hereinafter may be referred to as an "AUV") which does not require electric power supply from a mother ship and sails in water by a built-in power source for seabed work, seabed investigation, and the like. After the AUV is carried to a target marine area by the mother ship, the AUV is put into the sea from the mother ship and performs predetermined work under the sea surface. After the predetermined work, the AUV floats to the sea surface and is lifted to the mother ship.

Known as a typical method of lifting the AUV to the mother ship is a pop-up buoy method of lifting the AUV to the mother ship by: collecting a buoy, connected to a main body portion of the AUV by a rope, to the mother ship; and then winding the rope. For example, PTL 1 discloses that the AUV is lifted in such a manner that: when the AUV floats from under the sea surface, the AUV discharges a buoy with a rope; the buoy is collected by throwing a sand weight or the like from the mother ship and hooking the sand weight on the buoy; and then, the rope attached to the buoy is wound.

CITATION LIST

Patent Literature

PTL 1: Japanese Laid-Open Patent Application Publication No. 2012-229005

SUMMARY OF INVENTION

Technical Problem

According to the above-described AUV lifting method, to collect the buoy to the mother ship, the mother ship needs to approach the buoy. When the AUV floating on the sea surface and the buoy do not adequately separate from each other, the mother ship that has approached the buoy may collide with the AUV. Therefore, when the AUV floating on the sea surface and the buoy do not adequately separate from each other, the AUV moves backward such that the rope between the buoy and the AUV is extended. However, depending on oceanographic conditions, it is difficult to separate the AUV from the buoy in some cases, such as when the AUV cannot smoothly move backward or when the buoy moves from an original position. In such cases, a time spent for lifting work of the AUV increases, and in some cases, a diver needs to be dispatched from the mother ship to collect the buoy.

An object of the present invention is to provide an AUV which can facilitate lifting work of the AUV.

Solution to Problem

To solve the above problems, an AUV according to the present invention includes: an underwater vehicle main body incorporating a power source; a buoy connected to the underwater vehicle main body through a rope; and an ejector configured to, with the underwater vehicle main body floating on a sea surface, eject the buoy from the underwater vehicle main body by compressed gas in an obliquely upward direction.

According to the above configuration, with the underwater vehicle main body floating on the sea surface, the ejector ejects the buoy from the underwater vehicle main body in the obliquely upward direction. Therefore, the distance between the floating underwater vehicle main body and the buoy can be easily secured, and the mother ship can safely approach and collect the buoy. On this account, lifting work of the AUV can be easily performed.

The above AUV may be configured such that: an opening portion is provided at an upper portion of the underwater vehicle main body; and the ejector is arranged inside the underwater vehicle main body and ejects the buoy through the opening portion. According to this configuration, the ejector is arranged inside the underwater vehicle main body. Therefore, the AUV can proceed inside the sea with the ejector not receiving resistance of water.

The above AUV may be configured such that: the rope includes an extended portion connected to the buoy and extended by the ejected buoy and a lift portion connected to the underwater vehicle main body and used to lift the underwater vehicle main body; and the extended portion is smaller in diameter than the lift portion. According to this configuration, the rope includes the extended portion and the lift portion, and the extended portion is smaller in diameter than the lift portion. Therefore, to adequately secure the flying distance of the buoy, the extended portion can be reduced in weight, and the strength of the lift portion can be made adequate for lifting the underwater vehicle main body from the mother ship.

The above AUV may be configured such that a tail unit extending in a forward/rearward direction is provided at a rear side of an upper portion of the underwater vehicle main body. According to this configuration, the direction of the underwater vehicle main body can be determined by visually confirming the underwater vehicle main body and the tail unit from the mother ship. Therefore, before the buoy is ejected, the direction in which the buoy is ejected can be recognized in advance.

The above AUV may further include a receiver configured to receive an ejection signal based on which the ejector ejects the buoy. According to this configuration, the buoy can be ejected at desired timing by transmitting to the receiver the ejection signal based on which the ejector ejects the buoy.

The above AUV may be configured such that: the ejector is configured to release the compressed gas to an atmosphere by an electric signal; and the receiver receives a discharge signal based on which the ejector releases the compressed gas. According to this configuration, for example, even if the ejection of the buoy fails, the compressed gas of the ejector can be released to the atmosphere by transmitting to the receiver the discharge signal based on which the ejector releases the compressed gas. With this, a lift worker can safely approach the AUV.

Advantageous Effects of Invention

The present invention can provide an AUV which can facilitate lifting work of the AUV.

BRIEF DESCRIPTION OF DRAWINGS

FIG. 2A is a diagram showing the AUV which has floated on the sea surface. FIG. 2B is a diagram showing that a buoy is ejected. FIG. 2C is a diagram showing that the ejected buoy has landed on the sea.

DESCRIPTION OF EMBODIMENTS

Figure 1:
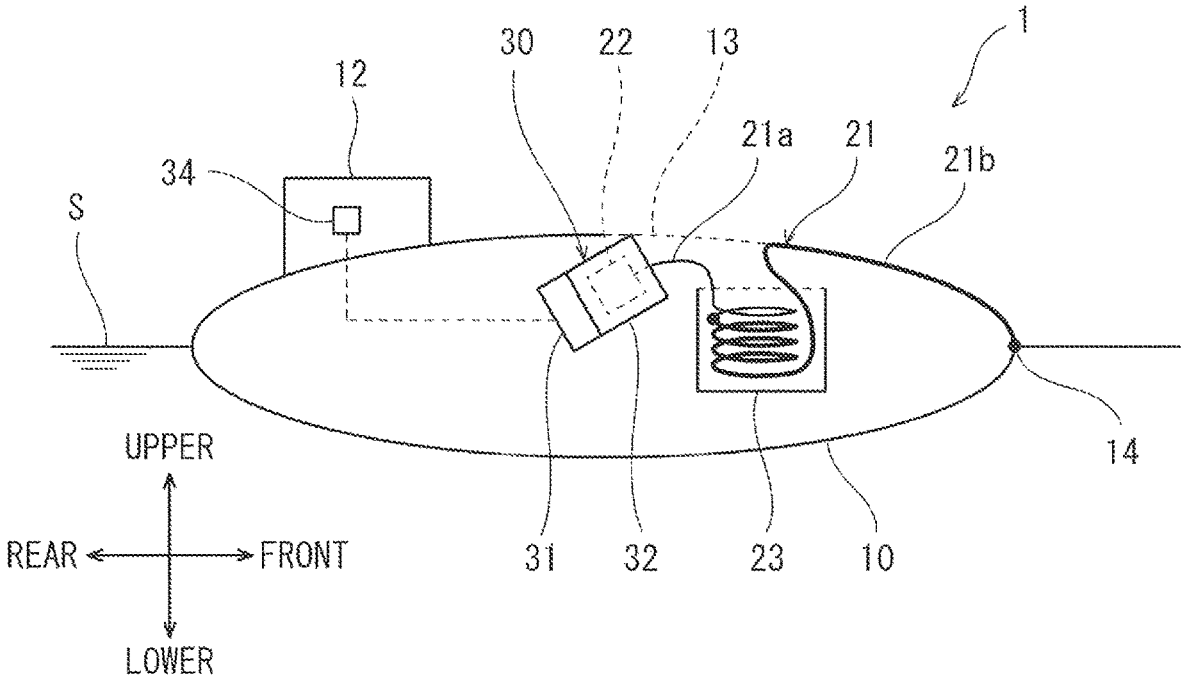
FIG. 1 is a schematic sectional side view showing an AUV according to one embodiment of the present invention.

Hereinafter, an embodiment of the present invention will be explained with reference to the drawings. FIG. 1 shows a schematic sectional side view showing an AUV 1 according to one embodiment. After the AUV 1 performs predetermined work under the sea surface, the AUV 1 floats to the sea surface S and is lifted to a mother ship 2 (see FIG. 2). FIG. 1 shows that the AUV 1 floats on the sea surface S. In the following explanations, a proceeding direction in which the AUV 1 proceeds is defined as a front direction, and a direction opposite to the proceeding direction is defined as a rear direction. Further, a direction toward the air when the AUV 1 floats to the sea surface S is defined as an upper direction, and a direction toward the sea water is defined as a lower direction.

The AUV 1 includes: an underwater vehicle main body 10 incorporating a storage battery as a power source; and some propulsion devices (not shown), such as propellers, configured to generate propulsive force by which the AUV 1 sails in water. A front portion of the underwater vehicle main body 10 has a streamline shape that is low in water resistance.

A tail unit 12 extending in a forward/rearward direction is provided at a rear side of an upper portion of the underwater vehicle main body 10. The tail unit 12 is a vertical blade configured to define a horizontal posture of the AUV 1. As described below, the tail unit 12 also serves as an index based on which the direction of the underwater vehicle main body 10 floating on the sea surface S is determined from the mother ship 2 (see FIG. 2).

The AUV 1 includes: a buoy 22 connected to the underwater vehicle main body 10 through a rope 21; and an ejector 30 configured to eject the buoy 22 from the underwater vehicle main body 10 in a front and obliquely upward direction. The buoy 22 is only required to float on the sea after landing on the sea surface S. The weight of the buoy 22 is adjusted such that a flying distance of the buoy 22 can be adequately secured. The flying distance is a distance from an ejecting spot to a landing spot. The ejector 30 is arranged inside the underwater vehicle main body 10 and ejects the buoy 22 through an opening portion 13 provided at a middle of the upper portion of the underwater vehicle main body 10.

With the underwater vehicle main body 10 floating on the sea surface S, the ejector 30 ejects the buoy 22 by compressed gas. For example, in the ejection of the buoy 22 by the ejector 30, the same mechanism as a publicly known life line shooting gun is utilized, the publicly known life line shooting gun being configured to shoot a life buoy bullet or the like by utilizing high pressure air or gas. Specifically, the ejector 30 includes: a base portion 31 including a chamber (not shown) configured to store compressed gas; and a tubular portion 32 coupled to the base portion 31. The chamber of the base portion 31 stores the compressed gas of, for example, 10 to 20 MPa. The tubular portion 32 is configured to be loaded with the buoy 22 and hold the buoy 22. For example, an 0 ring is provided at an inner wall of the tubular portion 32 which is substantially cylindrical, and the buoy 22 that is substantially columnar is fitted in the 0 ring to be held by the tubular portion 32.

The AUV 1 includes a receiver 34 configured to receive an ejection signal based on which the ejector 30 ejects the buoy 22. The receiver 34 transmits the received ejection signal to the ejector 30. When the ejector 30 receives the ejection signal from the receiver 34, the ejector 30 supplies the compressed gas, stored in the base portion 31, to the tubular portion 32 to eject the compressed gas toward the buoy 22. The buoy 22 receives, from the compressed gas, force larger than force by which the buoy 22 is held at the tubular portion 32. Thus, the buoy 22 is ejected from the tubular portion 32. It should be noted that the ejector 30 may be configured to switch between a state where the ejector 30 holds the buoy 22 and a state where the ejector 30 does not hold the buoy 22. In this case, when the ejector 30 receives the ejection signal of the buoy 22, the ejector 30 may switch from the state where the ejector 30 holds the buoy 22 to the state where the ejector 30 does not hold the buoy 22.

The ejector 30 is configured to be able to change an ejection angle of the buoy 22 with respect to the underwater vehicle main body 10. With this, the ejection angle appropriate for a weather condition when ejecting the buoy 22 can be set. For example, to reduce influence of strong wind on the ejected buoy 22, the ejection angle of the buoy 22 with respect to the sea surface S can be reduced, and with this, a flying duration of the buoy 22 can be reduced.

The rope 21 includes: one end connected to a coupling portion 14 provided at a front end of the underwater vehicle main body 10; and the other end connected to the buoy 22. While the buoy 22 is being loaded in the ejector 30, most of the rope 21 is accommodated in a rope accommodating portion 23 provided inside the underwater vehicle main body 10. To be specific, the rope 21 extends from the coupling portion 14 through the opening portion 13 to the rope accommodating portion 23 and further extends from the rope accommodating portion 23 to the buoy 22.

The rope 21 includes: an extended portion 21*a* which is extended by the ejected buoy 22; and a lift portion 21*b* for lifting the underwater vehicle main body 10. One end of the extended portion 21*a* and one end of the lift portion 21*b* are connected to each other. The other end of the extended portion 21*a* is connected to the buoy 22, and the other end of the lift portion 21*b* is connected to the coupling portion 14 of the underwater vehicle main body 10. The extended portion 21*a* is smaller in diameter than the lift portion 21*b*. For example, the diameter of the extended portion 21*a* is 6 mm, and the diameter of the lift portion 21*b* is 10 mm. As above, the extended portion 21*a* is smaller in diameter than the lift portion 21*b*. Therefore, to adequately secure the flying distance of the buoy 22, the extended portion 21*a* can be reduced in weight, and the strength of the lift portion 21*b* can be made adequate for lifting the underwater vehicle main body 10 from the mother ship 2.

By the ejection of the buoy 22, a part of the lift portion 21*b* may also be ejected to the sea and extended on the sea surface S together with the extended portion 21*a*. Further, the extended portion 21*a* does not have to entirely fly and be extended by the ejection of the buoy 22. For example, when the ejected buoy 22 lands on the sea, a part of the extended portion 21*a* may remain at the underwater vehicle main body 10.

The flying distance of the buoy 22 depends on the pressure of the compressed gas stored in the ejector 30, the ejection angle of the buoy 22 with respect to the sea surface S, the shape and weight of the buoy 22, the lengths of the extended portion 21*a* and the lift portion 21*b*, the weights of the extended portion 21*a* and the lift portion 21*b* per unit length, and the like. Further, the flying distance of the buoy 22 also depends on the weather condition when lifting the AUV 1. Most of the factors that determine the flying distance are known before the ejection of the buoy 22. Therefore, if the direction of the underwater vehicle main body 10 floating on the sea surface S is found out, a range where the buoy 22 ejected from the ejector 30 lands on the sea is predictable to some extent.

To easily find the landed buoy 22 from the mother ship 2, the buoy 22 may include, for example, a battery-powered light emitting body configured to be energizable when being ejected.

To safely lift the AUV 1 even if the ejection of the buoy 22 fails, such as if the ejection of the buoy 22 is not executed although the ejection signal is transmitted to the receiver 34, the ejector 30 can release the compressed gas to the atmosphere by an electric signal. The receiver 34 receives a discharge signal based on which the ejector 30 releases the compressed gas, and transmits the received discharge signal to the ejector 30. When the ejector 30 receives the discharge signal from the receiver 34, the ejector 30 releases the stored compressed gas to the atmosphere.

Next, the process of lifting the AUV 1, which has finished predetermined work, to the mother ship 2 floating on the sea will be explained with reference to FIG. 2.

Figure 2A:
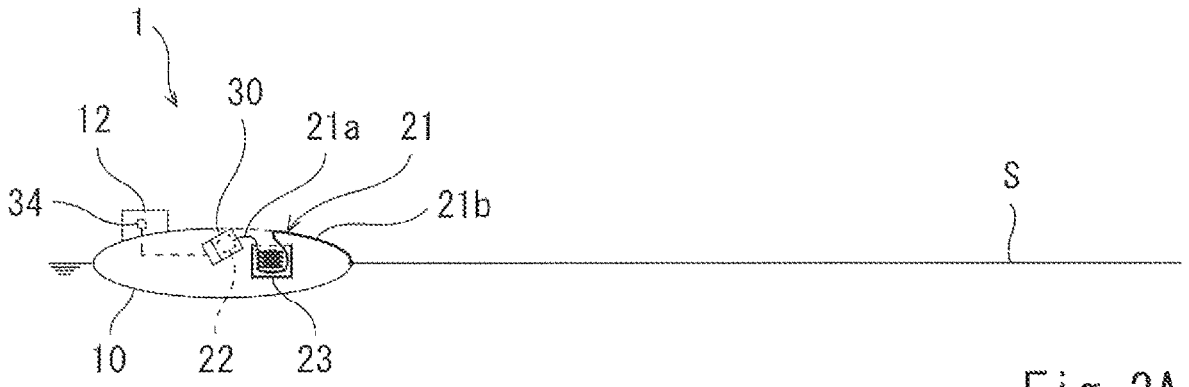
FIGS. 2A to 2C are diagrams for explaining lifting work of the AUV shown in FIG. 1.
Figure 2B:
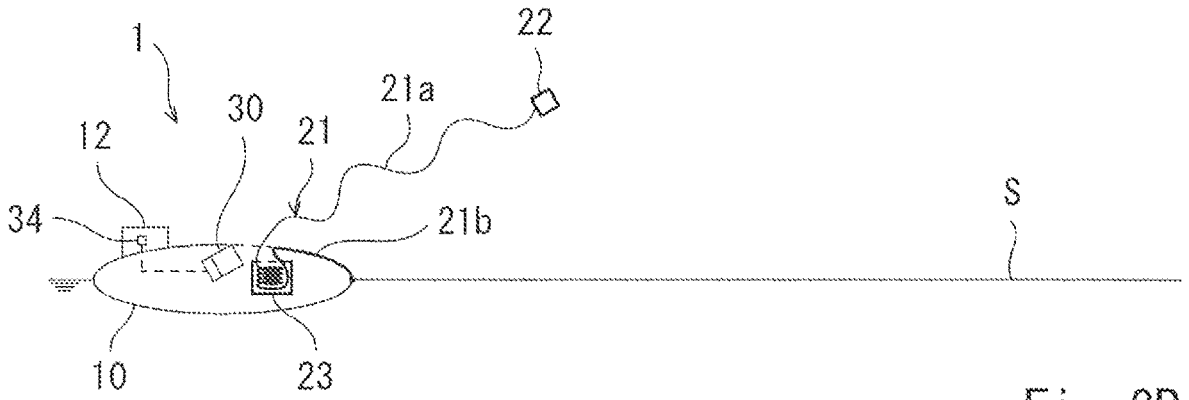
Figure 2C:
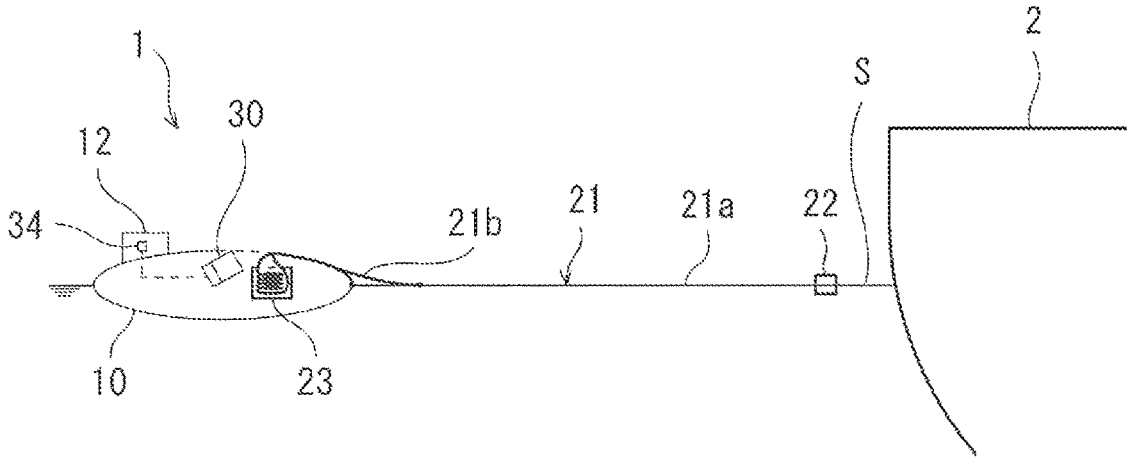

As shown in FIG. 2A, the AUV 1 that has finished the predetermined work floats to the sea surface S. A crew of the mother ship 2 visually confirms the tail unit 12 of the floating AUV 1, determines the direction of the underwater vehicle main body 10, and recognizes in advance the direction in which the buoy 22 is ejected. After the crew confirms that the mother ship 2 is located at a safe position, the ejection signal of the buoy 22 is transmitted from the mother ship 2 to the receiver 34, and as shown in FIG. 2B, the ejector 30 ejects the buoy 22 from the underwater vehicle main body 10 in an obliquely upward direction. As shown in FIG. 2C, after the buoy 22 lands on the sea, the mother ship 2 approaches and collects the buoy 22. After that, the rope 21 connected to the buoy 22 is wound by a lifting device (not shown) provided at the mother ship 2, and thus, the underwater vehicle main body 10 is lifted.

As explained above, according to the AUV 1 of the present embodiment, with the underwater vehicle main body 10 floating on the sea surface S, the ejector 30 ejects the buoy 22 from the underwater vehicle main body 10 in the obliquely upward direction. Therefore, the distance between the underwater vehicle main body 10 floating on the sea surface S and the buoy 22 can be easily secured, and the mother ship 2 can safely approach and collect the buoy 22. On this account, lifting work of the AUV 1 can be easily performed.

The ejector 30 ejects the buoy 22 by the compressed gas. Therefore, as compared to, for example, a method of ejecting the buoy 22 by force of a spring, the ejector 30 can be made smaller in configuration and eject the buoy 22 farther. On this account, a limited space inside the underwater vehicle main body 10 can be effectively utilized.

Since the ejector 30 is arranged inside the underwater vehicle main body 10, the AUV 1 can proceed inside the sea with the ejector 30 not receiving resistance of water.

The tail unit 12 extending in the forward/rearward direction is provided at the rear side of the upper portion of the underwater vehicle main body 10. Therefore, the direction of the underwater vehicle main body 10 can be determined by visually confirming the tail unit 12 of the AUV 1 from the mother ship 2. Therefore, before the buoy 22 is ejected, the direction in which the buoy 22 is ejected can be recognized in advance. On this account, work performed from when the buoy 22 lands on the sea until when the buoy 22 is collected by the mother ship 2 can be smoothly performed.

The AUV 1 includes the receiver 34 configured to receive the ejection signal based on which the ejector 30 ejects the buoy 22. Therefore, the buoy 22 can be ejected at desired timing by transmitting to the receiver 34 the ejection signal based on which the ejector 30 ejects the buoy 22. For example, the crew of the mother ship 2 can eject the buoy 22 after confirming that the mother ship 2 is located at a safe position with respect to the ejected buoy 22.

For example, even if the ejection of the buoy 22 fails, the compressed gas of the ejector 30 can be released to the atmosphere by transmitting to the receiver 34 the discharge signal based on which the ejector 30 releases the compressed gas. With this, a lift worker can safely approach the AUV 1.

The above embodiment is in all aspects illustrative, and should be interpreted as not restrictive. The scope of the present invention is defined by the appended claims rather than by the description preceding them, and all changes that fall within metes and bounds of the claims, or equivalence of such metes and bounds thereof are therefore intended to be embraced by the claims.

For example, in the above embodiment, the ejector 30 is configured to eject the buoy 22 from the underwater vehicle main body 10 in the front and obliquely upward direction. However, the ejector 30 may eject the buoy 22 in a rear and obliquely upward direction, a right and obliquely upward direction, or a left and obliquely upward direction.

In the above embodiment, the ejector 30 is arranged inside the underwater vehicle main body 10. However, the ejector 30 may be provided on an outer surface of the underwater vehicle main body 10 as long as the ejector 30 does not receive resistance of water so much. In this case, the underwater vehicle main body 10 is not required to have the opening portion 13 through which the buoy 22 passes.

In the above embodiment, the rope 21 includes the extended portion 21*a* and the lift portion 21*b* that is larger in diameter than the extended portion 21*a*. However, the above embodiment is not limited to this. For example, the rope 21 may have a constant diameter from one end to the other end as long as the rope 21 has such weight that the flying distance of the buoy 22 can be adequately secured and has such adequate strength that the underwater vehicle main body 10 can be lifted from the mother ship 2.

The position of the tail unit 12 provided at the underwater vehicle main body 10 is not limited to the above embodiment. A method of determining the direction of the underwater vehicle main body 10 from the mother ship 2 is not limited to a method of visually confirming the tail unit 12 from the mother ship 2 and may be a different method.

In addition to or instead of the receiver 34, the AUV 1 may include: a sensor configured to detect that the underwater vehicle main body 10 floats on the sea surface S; and a timer configured to measure an elapsed time from when the underwater vehicle main body 10 has floated on the sea surface S. In this case, the ejector 30 may be configured to automatically eject the buoy 22 after a predetermined time elapses since the underwater vehicle main body 10 has floated. Further, the ejector 30 may be configured to automatically release the compressed gas to the atmosphere after a predetermined time elapses since the underwater vehicle main body 10 has floated.

The ejection signal and discharge signal transmitted to the receiver 34 do not have to be directly transmitted from the receiver 34 to the ejector 30 and may be transmitted through a control portion provided inside the underwater vehicle main body 10.

REFERENCE SIGNS LIST

1 AUV (autonomous underwater vehicle)
10 underwater vehicle main body
12 tail unit
13 opening portion
21 rope
21*a* extended portion
21*b* lift portion
22 buoy
30 ejector
34 receiver
S sea surface

The invention claimed is:

1. An autonomous underwater vehicle comprising:

an autonomous underwater vehicle main body incorporating a power source;

a buoy connected to the autonomous underwater vehicle main body through a rope; and an ejector configured to, with the autonomous underwater vehicle main body floating on a sea surface, eject the buoy into air from the autonomous underwater vehicle main body by compressed gas in an obliquely upward direction, the ejector including:

a base portion including a chamber configured to store the compressed gas having pressure of 10 MPa or more, and a tubular portion coupled to the base portion, the tubular portion being configured to hold the buoy, wherein the ejector supplies the compressed gas, stored in the base portion, to the tubular portion to eject the compressed gas toward the buoy and eject the buoy from the tubular portion.

2. The autonomous underwater vehicle according to claim 1, wherein:

an opening portion is provided at an upper portion of the autonomous underwater vehicle main body; and the ejector is arranged inside the autonomous underwater vehicle main body and ejects the buoy through the opening portion.

3. The autonomous underwater vehicle according to claim 1, wherein:

the rope includes:

an extended portion connected to the buoy and extended by the ejected buoy, and a lift portion connected to the autonomous underwater vehicle main body and configured to lift the autonomous underwater vehicle main body; and the extended portion is smaller in diameter than the lift portion.

4. The autonomous underwater vehicle according to claim 1, wherein a tail extends in a forward/rearward direction and is located at a rear side of an upper portion of the autonomous underwater vehicle main body.

5. The autonomous underwater vehicle according to claim 1, further comprising a receiver configured to receive an ejection signal based on which the ejector ejects the buoy.

6. The autonomous underwater vehicle according to claim 5, wherein:

the ejector is configured to release the compressed gas to an atmosphere by an electric signal; and the receiver receives a discharge signal based on which the ejector releases the compressed gas.

* * * * *